US010794176B2

(12) United States Patent
Miller et al.

(10) Patent No.: US 10,794,176 B2
(45) Date of Patent: Oct. 6, 2020

(54) DRILL STRING LENGTH MEASUREMENT IN MEASUREMENT WHILE DRILLING SYSTEM

(71) Applicant: Erdos Miller, Inc., Houston, TX (US)

(72) Inventors: Kenneth C. Miller, Houston, TX (US); David Erdos, Houston, TX (US); Abraham C. Erdos, Houston, TX (US)

(73) Assignee: Erdos Miller, Inc., Houston, TX (US)

( * ) Notice: Subject to any disclaimer, the term of this patent is extended or adjusted under 35 U.S.C. 154(b) by 68 days.

(21) Appl. No.: 16/055,147

(22) Filed: Aug. 5, 2018

(65) Prior Publication Data

US 2020/0040723 A1 Feb. 6, 2020

(51) Int. Cl.

| | |
|---|---|
| ***E21B 47/09*** | (2012.01) |
| ***E21B 47/095*** | (2012.01) |
| ***E21B 47/18*** | (2012.01) |
| ***E21B 47/13*** | (2012.01) |

(52) U.S. Cl.

CPC ..... *E21B 47/095* (2020.05); *E21B 47/09* (2013.01); *E21B 47/13* (2020.05); *E21B 47/18* (2013.01)

(58) Field of Classification Search

CPC ..... E21B 47/091; E21B 47/09; E21B 47/095
See application file for complete search history.

(56) References Cited

U.S. PATENT DOCUMENTS

| | | | |
|---|---|---|---|
| 1,719,568 | A | 7/1929 | Spies |
| 3,524,162 | A | 8/1970 | Zill |
| 5,519,668 | A | 5/1996 | Montaron |
| 5,592,438 | A | 1/1997 | Rorden et al. |
| 5,924,499 | A | 7/1999 | Birchak et al. |
| 6,308,137 | B1 | 10/2001 | Underhill et al. |
| 6,424,595 | B1 | 7/2002 | Chenin |
| 6,439,046 | B1 | 8/2002 | Kruspe et al. |
| 6,606,009 | B2 | 8/2003 | Gunawardana et al. |
| 6,618,674 | B2 | 9/2003 | Ireland et al. |
| 7,142,129 | B2 | 11/2006 | Hall et al. |
| 7,230,543 | B2 | 6/2007 | Minto et al. |
| 7,535,800 | B2 | 5/2009 | Sanders et al. |

(Continued)

FOREIGN PATENT DOCUMENTS

| | | | |
|---|---|---|---|
| EP | 0684490 | B1 | 11/1995 |
| EP | 1053488 | B1 | 11/2000 |

(Continued)

*Primary Examiner* — Kristyn A Hall
(74) *Attorney, Agent, or Firm* — Faegre Drinker Biddle & Reath LLP

(57) ABSTRACT

A measurement while drilling system for a drill string having a fluidic medium in the drill string. The measurement while drilling system includes a first module situated at a distal end of the drill string and including a downhole processor and a pulser communicatively coupled to the downhole processor and configured to provide a pressure pulse in the fluidic medium, and a second module situated at a proximal end of the drill string and including an uphole processor and a pressure sensor communicatively coupled to the uphole processor. The downhole processor is configured to direct the pulser to provide the pressure pulse and the pressure sensor is configured to sense the pressure pulse. The uphole processor is configured to receive signals from the pressure sensor to determine a distance from the first module to the second module.

16 Claims, 6 Drawing Sheets

(56) References Cited

U.S. PATENT DOCUMENTS

| | | | | |
|---|---|---|---|---|
| 7,633,834 | B2 | 12/2009 | Mathiszik et al. | |
| 7,913,773 | B2 | 3/2011 | Li et al. | |
| 8,749,400 | B2 | 6/2014 | Robbins | |
| 8,902,695 | B2 | 12/2014 | Dashevskiy et al. | |
| 2006/0146646 | A1 | 7/2006 | Fanini et al. | |
| 2008/0008043 | A1 | 1/2008 | Jong | |
| 2008/0137474 | A1 | 6/2008 | Dashevskiy et al. | |
| 2014/0169129 | A1 | 6/2014 | Orban | |
| 2015/0096805 | A1* | 4/2015 | Kruspe | E21B 7/04 175/45 |
| 2015/0218929 | A1 | 8/2015 | Narasimhan et al. | |
| 2017/0114630 | A1 | 4/2017 | Erdos et al. | |
| 2017/0218745 | A1 | 8/2017 | Erdos et al. | |
| 2017/0254189 | A1 | 9/2017 | Tamboise | |

FOREIGN PATENT DOCUMENTS

| | | | |
|---|---|---|---|
| EP | 1604096 | B1 | 12/2005 |
| EP | 1684935 | B1 | 8/2006 |
| WO | WO2004074633 | A1 | 9/2004 |
| WO | WO2008070754 | A1 | 6/2008 |
| WO | WO2009062040 | A2 | 5/2009 |
| WO | WO2016200766 | A1 | 12/2016 |

* cited by examiner

DRILL STRING LENGTH MEASUREMENT IN MEASUREMENT WHILE DRILLING SYSTEM

TECHNICAL FIELD

The present disclosure relates to measurement while drilling (MWD) systems. More specifically, the disclosure relates to drill string length measurements.

BACKGROUND

Drilling systems can be used for drilling well boreholes in the earth for extracting fluids, such as oil, water, and gas. Drilling systems include a drill string for boring the well borehole into a formation that contains the fluid to be extracted. The drill string includes tubing or a drill pipe, such as a pipe made-up of jointed sections, and a drilling assembly attached to the distal end of the drill string. The drilling assembly includes a drill bit at the distal end of the drilling assembly. Typically, the drill string, including the drill bit, is rotated to drill the well borehole. Often, the drilling assembly includes a mud motor that rotates the drill bit for boring the well borehole.

Drilling fluid, such as mud, is pumped under pressure from a source at the surface, such as a mud pit, through the drill string. This drilling fluid can be used to fulfill a number of different needs during drilling operations. The drilling fluid can be used to provide hydrostatic pressure that is greater than the formation's pressure to prevent blowouts, to drive the mud motor for drilling the well borehole, and to provide lubrication to elements of the drill string during drill operations.

Often, while drilling the well borehole, information about formations in the earth is gathered and relayed to the surface. Taking downhole measurements during drilling operations is known as MWD or logging while drilling (LWD). One measurement of interest is the length of the drill string, which can be related to the depth of the well borehole and/or the location of the drill bit in the well borehole. Accurate measurements of the length of the drill string have been difficult to obtain.

SUMMARY

In a first example, an MWD system, for a drill string having a fluidic medium in the drill string, includes a first module situated at a distal end of the drill string and including a downhole processor and a pulser communicatively coupled to the downhole processor and configured to provide a pressure pulse in the fluidic medium, and a second module situated at a proximal end of the drill string and including an uphole processor and a pressure sensor communicatively coupled to the uphole processor. The downhole processor is configured to direct the pulser to provide the pressure pulse and the pressure sensor is configured to sense the pressure pulse. The uphole processor is configured to receive signals from the pressure sensor to determine a distance from the first module to the second module.

In a second example according to the first example, the downhole processor and the uphole processor are synchronized in time and the downhole processor is configured to direct the pulser to provide the pressure pulse at a first time. The pressure sensor senses the pressure pulse at a second time, and the uphole processor is configured to determine a difference in time between the first time and the second time to determine the distance from the first module to the second module.

In a third example according to the second example, the first module comprises a first oscillator electrically coupled to the downhole processor and the second module comprises a second oscillator electrically coupled to the uphole processor. The first oscillator is synchronized to the second oscillator to synchronize the downhole processor and the uphole processor.

In a fourth example according to the second example, the difference in time is multiplied times the speed of the pressure pulse through the fluidic medium to determine the distance from the first module to the second module.

In a fifth example according to the first example, the first module comprises an electromagnetic wave transmitter configured to transmit an electromagnetic wave and the downhole processor is configured to direct the pulser to provide the pressure pulse and the electromagnetic wave transmitter to transmit the electromagnetic wave at the same time.

In a sixth example according to the fifth example, the second module includes an electromagnetic wave antenna to receive the electromagnetic wave.

In a seventh example according to the sixth example, the electromagnetic wave antenna receives the electromagnetic wave at a first time and the pressure sensor receives the pressure pulse at a second time. The uphole processor is configured to determine a difference in time between the first time and the second time to determine the distance from the first module to the second module.

In an eighth example according to the seventh example, at least one of: the difference in time is multiplied times the speed of the pressure pulse through the fluidic medium to determine the distance from the first module to the second module, and the difference in time is adjusted for travel time of the electromagnetic wave and the adjusted difference in time is multiplied times the speed of the pressure pulse through the fluidic medium to determine the distance from the first module to the second module.

In a ninth example according to the first example, the fluidic medium includes mud used in drilling and the pressure pulse travels through a mud channel in the drill string.

In a tenth example according to the first example, the downhole processor is configured to periodically direct the pulser to provide the pressure pulse.

In an eleventh example, an MWD system, for a drill string with a fluidic medium in the drill string, includes a first module situated at a distal end of the drill string and including a pulser configured to provide a pressure pulse in the fluidic medium, and a second module situated at a proximal end of the drill string and including a pressure sensor. The pulser provides the pressure pulse and the pressure sensor senses the pressure pulse to determine a distance from the first module to the second module and to determine a length of the drill string.

In a twelfth example according to the eleventh example, the first module comprises a downhole processor communicatively coupled to the pulser, and the second module comprises an uphole processor communicatively coupled to the pressure sensor. The downhole processor and the uphole processor are synchronized in time, and the downhole processor is configured to direct the pulser to provide the pressure pulse at a first time. The pressure sensor senses the pressure pulse at a second time, and the uphole processor is configured to determine a difference in time between the first time and the second time to determine the distance from the first module to the second module and to determine the length of the drill string.

In a thirteenth example according to the eleventh example, the first module comprises a downhole processor and an electromagnetic wave transmitter, the downhole processor communicatively coupled to the pulser and the electromagnetic wave transmitter, and the second module comprises an uphole processor and an electromagnetic wave antenna, the uphole processor communicatively coupled to the pressure sensor and the electromagnetic wave antenna. The downhole processor is configured to direct the pulser to provide the pressure pulse and the electromagnetic wave transmitter to transmit the electromagnetic wave at the same time, such that the electromagnetic wave antenna receives the electromagnetic wave at a first time and the pressure sensor receives the pressure pulse at a second time. The uphole processor is configured to determine a difference in time between the first time and the second time to determine the distance from the first module to the second module and to determine the length of the drill string.

In a fourteenth example, a method of determining a length of a drill string in a MWD system, the drill string having a fluidic medium in the drill string. The method comprising situating a first module that includes a downhole processor and a pulser at a distal end of the drill string, situating a second module that includes an uphole processor and a pressure sensor at a proximal end of the drill string, directing the pulser, by the downhole processor, to provide a pressure pulse through the fluidic medium, sensing the pressure pulse at the pressure sensor, receiving signals from the pressure sensor at the uphole processor, and determining a distance from the first module to the second module based on the signals from the pressure sensor to determine the length of the drill string.

In a fifteenth example according to the fourteenth example, the method comprising synchronizing the downhole processor and the uphole processor, directing the pulser, by the downhole processor, to provide the pressure pulse at a first time, sensing the pressure pulse at the pressure sensor at a second time, and determining a difference in time between the first time and the second time to determine the distance from the first module to the second module.

In a sixteenth example according to the fifteenth example, synchronizing the downhole processor and the uphole processor includes synchronizing a first oscillator electrically coupled to the downhole processor and a second oscillator electrically coupled to the uphole processor.

In a seventeenth example according to the fifteenth example, the method comprising multiplying the difference in time by the speed of the pressure pulse through the fluidic medium to determine the distance from the first module to the second module.

In an eighteenth example according to the fourteenth example, the method comprising providing an electromagnetic wave transmitter in the first module, and directing, by the downhole processor, the pulser to provide the pressure pulse and the electromagnetic wave transmitter to transmit an electromagnetic wave at the same time.

In a nineteenth example according to the eighteenth example, the method comprising providing an electromagnetic wave antenna on the second module to receive the electromagnetic wave, receiving the electromagnetic wave at the electromagnetic wave antenna at a first time, receiving the pressure pulse at the pressure sensor at a second time, and determining, by the uphole processor, a difference in time between the first time and the second time to determine the distance from the first module to the second module.

In a twentieth example according to the nineteenth example, the method comprising at least one of: multiplying the difference in time by the speed of the pressure pulse through the fluidic medium to determine the distance from the first module to the second module; and adjusting the difference in time for travel time of the electromagnetic wave and multiplying the adjusted difference in time by the speed of the pressure pulse through the fluidic medium to determine the distance from the first module to the second module.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
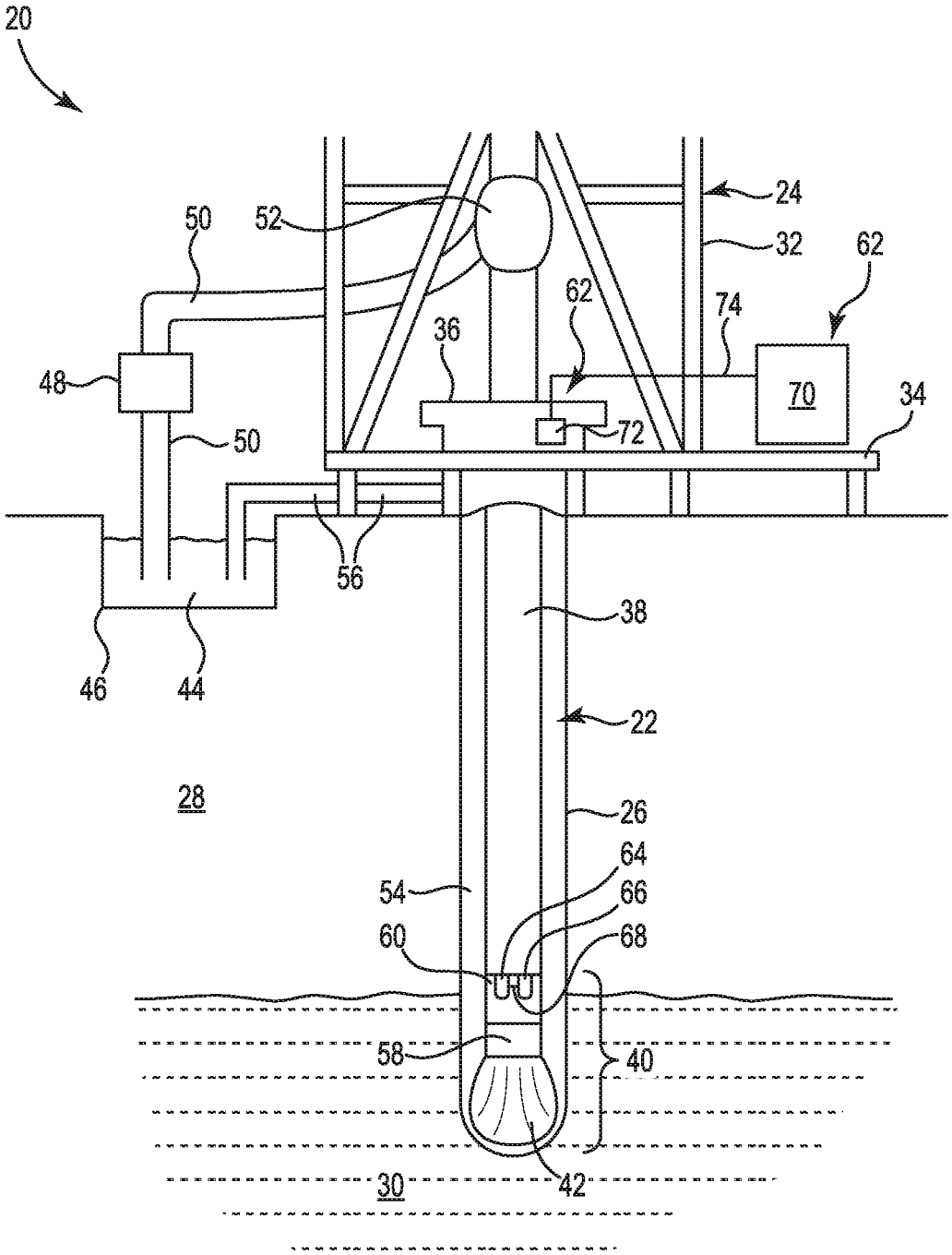
FIG. 1 is a diagram illustrating a MWD system configured for measuring the length of a drill string, according to embodiments of the disclosure.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

FIG. 1 is a diagram illustrating a MWD system 20 configured for measuring the length of a drill string 22, according to embodiments of the disclosure. The system 20 includes the drill string 22 and a rig 24 for drilling a well borehole 26 through earth 28 and into a formation 30. After the well borehole 26 has been drilled, fluids such as water, oil, and gas can be extracted from the formation 30. In some embodiments, the rig 24 is situated on a platform that is on or above water for drilling into the ocean floor.

The rig 24 includes a derrick 32, a derrick floor 34, a rotary table 36, and the drill string 22. The drill string 22 includes a drill pipe 38 and a drilling assembly 40 attached to the distal end of the drill pipe 38 at the distal end of the drill string 22. The drilling assembly 40 includes a drill bit 42 at the bottom of the drilling assembly 40 for drilling the well borehole 26.

A fluidic medium, such as drilling mud 44, is used by the system for drilling the well borehole 26. The fluidic medium circulates through the drill string 22 and back to the fluidic medium source, which is usually at the surface. In embodiments, drilling mud 44 is drawn from a mud pit 46 and circulated by a mud pump 48 through a mud supply line 50 and into a swivel 52. The drilling mud 44 flows down through an axial central bore in the drill string 22 and through jets (not shown) in the lower face of the drill bit 42. Borehole fluid 54, which contains drilling mud 44, formation cuttings, and formation fluid, flows back up through the annular space between the outer surface of the drill string 22 and the inner surface of the well borehole 26 to be returned to the mud pit 46 through a mud return line 56. A filter (not shown) can be used to separate formation cuttings from the drilling mud 44 before the drilling mud 44 is returned to the mud pit 46. In some embodiments, the drill string 22 has a downhole drill motor 58, such as a mud motor, for rotating the drill bit 42.

The system 20 is configured to measure the length of the drill string 22. The system 20, in the drilling assembly 40, includes a first module 60 at the distal end of the drill pipe 38 and the distal end of the drill string 22. Also, the system 20 includes a second module 62 attached to the drill rig 24 at the surface and at the proximal end of the drill string 22. The first module 60 includes a downhole processor 64 and a pulser 66, such as a mud pulse valve, communicatively coupled, such as electrically coupled by wire 68 or wirelessly coupled, to the downhole processor 64. The pulser 66 is configured to provide a pressure pulse in the fluidic medium in the drill string 22, such as the drilling mud 44. The second module 62 includes an uphole processor 70 and a pressure sensor 72 communicatively coupled, such as electrically coupled by wire 74 or wirelessly coupled, to the uphole processor 70. In some embodiments, the pressure pulse is an acoustic signal.

In some embodiments, the pulser 66 is configured to provide an acoustic signal, such as one or more pulses, that is transmitted to the surface through one or more transmission medium or pathways. The pathways can include through the fluidic medium in the drill string 22, through the material (such as metal) that the pipe is made of, and through one or more other separate pipes or pieces of material that accompany the drill string 22, where the acoustic signal can be transmitted through the passageway of the separate pipe or through the material of the separate pipe or piece of material that accompanies the drill string 22. In some embodiments, the second module 62 includes the uphole processor 70 and an acoustic signal sensor configured to receive the acoustic signal and communicatively coupled, such as electrically coupled by wire or wirelessly coupled, to the uphole processor 70.

In embodiments, each of the downhole processor 64 and the uphole processor 70 is a computing machine that includes memory that stores executable code that can be executed by the computing machine to perform the processes and functions described in this disclosure. In embodiments, the computing machine is one or more of a computer, a microprocessor, and a micro-controller, or the computing machine includes multiples of a computer, a microprocessor, and a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, each of the first module 60 and the second module 62 includes one or more power supplies for providing power to the module.

In operation, the downhole processor 64 is configured to direct the pulser 66 to provide the pressure pulse in the fluid medium, such as the drilling mud 44, and the pressure sensor 72 is configured to sense the pressure pulse in the fluidic medium. The uphole processor 70 is configured to receive signals from the pressure sensor 72 to determine a distance from the first module 60 to the second module 62, which is basically the distance or length of the drill string 22. This distance can be used to determine the length of the well borehole 26 and, with other telemetry data about the well borehole 26, such as inclination and azimuth along the well borehole 26, the position of the drill bit 42 in the well borehole 26.

In some embodiments, the downhole processor 64 is configured to direct the pulser 66 to provide the acoustic signal and the acoustic sensor at the surface is configured to sense the acoustic signal. The uphole processor 70 is configured to receive signals from the sensor to determine a distance from the first module 60 to the second module 62, which is basically the distance or length of the drill string 22. This distance can be used to determine the length of the well borehole 26 and, with other telemetry data about the well borehole 26, such as inclination and azimuth along the well borehole 26, the position of the drill bit 42 in the well borehole 26.

Figure 2:
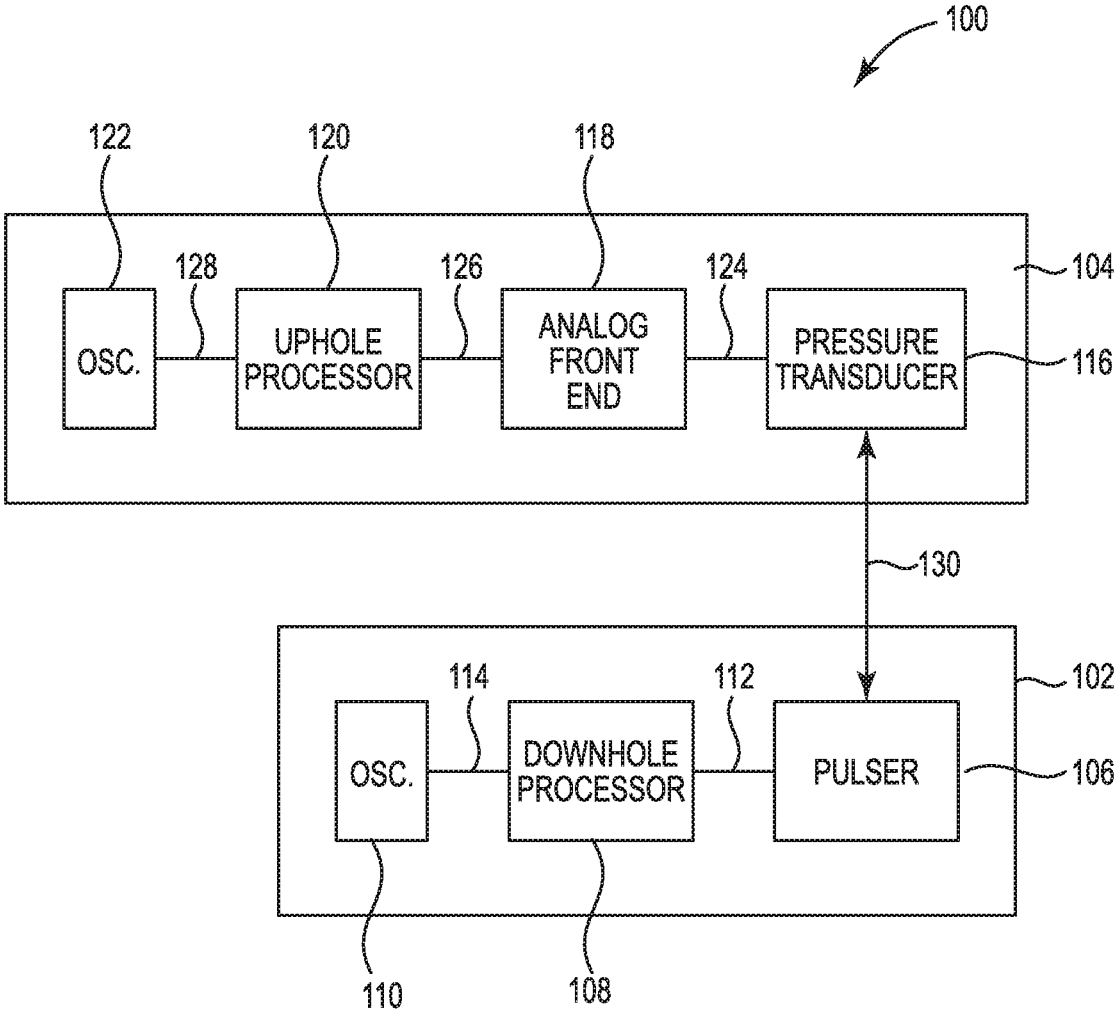
FIG. 2 is a diagram illustrating an MWD system configured to measure the length of a drill string using synchronous clocks and pulses through a fluidic medium in the drill string, according to embodiments of the disclosure.

FIG. 2 is a diagram illustrating an MWD system 100 configured to measure the length of a drill string, such as drill string 22, using synchronous clocks and pulses through a fluidic medium in the drill string, according to embodiments of the disclosure. The MWD system 100 includes a first module 102 and a second module 104 configured to communicate through the fluidic medium in the drill string. In some embodiments, the MWD system 100 is similar to the MWD system 20 of FIG. 1. In some embodiments, the first module 102 is similar to the first module 60 (shown in FIG. 1). In some embodiments, the second module 104 is similar to the second module 62 (shown in FIG. 1).

In other embodiments, the MWD system 100 is configured to measure the length of the drill string, such as drill string 22, using synchronous clocks as described herein and using acoustic signals through a transmission medium in place of the pulses through the fluidic medium.

The first module 102 is a downhole module situated at the distal end of the drill pipe, such as drill pipe 38, and situated at the distal end of the drill string 22. In some embodiments, the first module 102 is securely attached to the drill pipe. In some embodiments, the first module 102 is rotatably attached to the drill pipe.

The first module 102 includes a pulser 106, a downhole processor 108, and an oscillator 110. The pulser 106 is communicatively coupled at 112 to the downhole processor 108, and the oscillator 110 is communicatively coupled at 114 to the downhole processor 108. In some embodiments, the pulser 106 is electrically coupled at 112 to the downhole processor 108. In some embodiments, the oscillator 110 is electrically coupled at 114 to the downhole processor 108.

The pulser 106 is situated at the distal end of the drill string and configured to provide a pressure pulse in the fluidic medium, such as the drilling mud, in the drill string. In some embodiments, the pulser 106 is a mud pulse valve.

The downhole processor 108 is configured to direct the pulser 106 to provide the pressure pulse in the fluidic medium at a certain time. In embodiments, the downhole processor 108 is a computing machine that includes memory that stores executable code that can be executed by the computing machine to perform the processes and functions described in this disclosure. In embodiments, the computing machine is one or more of a computer, a microprocessor, and a micro-controller, or the computing machine includes multiples of a computer, a microprocessor, and a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, the first module 102 includes one or more power supplies for providing power to the components of the first module 102, such as the pulser 106, the downhole processor 108, and the oscillator 110.

The oscillator 110 provides a signal that is received by the downhole processor 108 and used by the downhole processor 108 to provide a timer or clock. Based on this timer, the downhole processor 108 directs the pulser 106 to provide the pressure pulse in the fluidic medium at a certain time. In some embodiments, the oscillator 110 is a high precision oscillator. In some embodiments, the oscillator 110 provides a high frequency oscillating signal, such as an analog signal or a digital signal that is received by the downhole processor 108 for clocking the timer in the downhole processor 108. In some embodiments, the oscillator 110 provides a count, such as from a high precision counter, which is received by the downhole processor 108 for providing the timer in the downhole processor 108.

The second module 104 is an uphole module situated at the proximal end of the drill string, such as drill string 22. In some embodiments, the second module 104 is attached to the drill rig, such as drill rig 24. In some embodiments, the second module 104 is attached to the drill rig at the surface. In some embodiments, the second module 104 is securely attached to the drill rig. In some embodiments, the second module 104 is rotatably attached to the drill rig.

The second module 104 includes a pressure transducer 116, an analog signal front end 118, an uphole processor 120, and an oscillator 122. The pressure transducer 116 is communicatively coupled at 124 to the analog signal front end 118, which is communicatively coupled at 126 to the uphole processor 120, which is communicatively coupled at 128 to the oscillator 122. In some embodiments, the pressure transducer 116 is electrically coupled at 124 to the analog signal front end 118. In some embodiments, the analog signal front end 118 is electrically coupled at 126 to the uphole processor 120. In some embodiments, the uphole processor 120 is electrically coupled at 128 to the oscillator 122.

The pressure transducer 116 operates as a sensor to sense the pressure pulse provided by the pulser 106. The pressure transducer 116 provides signals, such as analog signals, to the analog signal front end 118 that receives the signals from the pressure transducer 116 and filters the signals to provide filtered signals to the uphole processor 120.

The uphole processor 120 receives the filtered signals from the analog signal front end 118 and determines a distance from the first module 102 to the second module 104. In some embodiments, the uphole processor 120 receives the signals directly from the pressure transducer 116 and determines a distance from the first module 102 to the second module 104. In some embodiments, the uphole processor 120 is a computing machine that includes memory that stores executable code that can be executed by the computing machine to perform the processes and functions described in this disclosure. In embodiments, the computing machine is one or more of a computer, a microprocessor, and a micro-controller, or the computing machine includes multiples of a computer, a microprocessor, and a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, the second module 104 includes one or more power supplies for providing power to the components of the second module 104, such as the pressure transducer 116, the analog signal front end 118, the uphole processor 120, and the oscillator 122.

The oscillator 122 provides a signal that is received by the uphole processor 120 to provide a timer or clock in the uphole processor 120. Based on this timer, the uphole processor 120 determines the distance from the first module 102 to the second module 104. In some embodiments, the oscillator 122 is a high precision oscillator. In some embodiments, the oscillator 122 provides a high frequency oscillating signal, such as an analog signal or a digital signal, which is received by the uphole processor 120 for clocking the timer in the uphole processor 120. In some embodiments, the oscillator 122 provides a count, such as from a high precision counter, which is received by the uphole processor 120 for providing the timer in the uphole processor 120.

In operation, the downhole processor 108 and the uphole processor 120 are synchronized in time. In some embodiments, to synchronize the downhole processor 108 and the uphole processor 120, the oscillator coupled to the downhole processor 108 is synchronized to the oscillator coupled to the uphole processor 120. In some embodiments, to synchronize the downhole processor 108 and the uphole processor 120, the timer in the downhole processor 108 and the timer in the uphole processor 120 are synchronized. In some embodiments, synchronization is done at the surface prior to drilling. In some embodiments, synchronization is done at the surface prior to directing the first module 104 down a well borehole that was previously drilled. In some embodiments, synchronization is done when the first module 104 is down in the well borehole.

Next, the downhole processor 108 directs the pulser 106 to provide the pressure pulse through the fluidic medium channel 130 at a first time. Where, this first time is coordinated with and known by the uphole processor 120. In some embodiments, the downhole processor 108 is configured to direct the pulser 106 to provide the pressure pulse periodically, such as once every minute. In some embodiments, the downhole processor 108 is configured to direct the pulser 106 to provide multiple pressure pulses at each time, where the multiple pulses can be provided at one frequency, such as one per second for a period of time, or at a changing frequency, such as one per second and then one every two seconds for a period of time.

The pressure transducer 116 senses the pressure pulse at a second time and sends signals indicating arrival of the pressure pulse to the analog signal front end 118, which sends filtered signals to the uphole processor 120. The uphole processor 120 receives the filtered signals (or signals directly from the pressure transducer 116) indicating the arrival of the pressure pulse at the pressure transducer 118, and the uphole processor 120 determines the difference in time between the first time and the second time.

To determine the distance from the first module 102 (pulser 106) to the second module 104 (pressure transducer 116), the uphole processor 120 multiples this difference in time between the first time and the second time by the speed of the pressure pulse through the fluidic medium. The result is the distance from the first module 102 to the second module 104. In some embodiments, the speed of the pressure pulse through the fluidic medium, such as drilling mud, is about 5000 feet per second, such that if the difference in time is 3 seconds, the distance from the first module 102 to the second module 104 is 15,000 feet.

In other embodiments, in operation, the downhole processor 108 and the uphole processor 120 are synchronized in time, as previously described, and the downhole processor 108 directs the pulser 106 to provide an acoustic signal at a first time. Where, this first time is coordinated with and known by the uphole processor 120. In some embodiments, the downhole processor 108 is configured to direct the pulser 106 to provide the acoustic signal periodically, such as once every minute. In some embodiments, the downhole processor 108 is configured to direct the pulser 106 to provide multiple acoustic signals at each time, where the signals can be provided at one frequency, or at changing frequencies.

An acoustic sensor at the surface senses the acoustic signal at a second time and sends signals indicating arrival of the signal to the analog signal front end 118, which sends filtered signals to the uphole processor 120. The uphole processor 120 receives the filtered signals (or signals directly from the acoustic sensor) indicating the arrival of the acoustic signal at the sensor, and the uphole processor 120 determines the difference in time between the first time and the second time.

To determine the distance from the first module 102 (pulser 106) to the second module 104 (acoustic sensor), the uphole processor 120 multiples this difference in time between the first time and the second time by the speed of the acoustic signal through the transmission medium. The result is the distance from the first module 102 to the second module 104.

Figure 3:
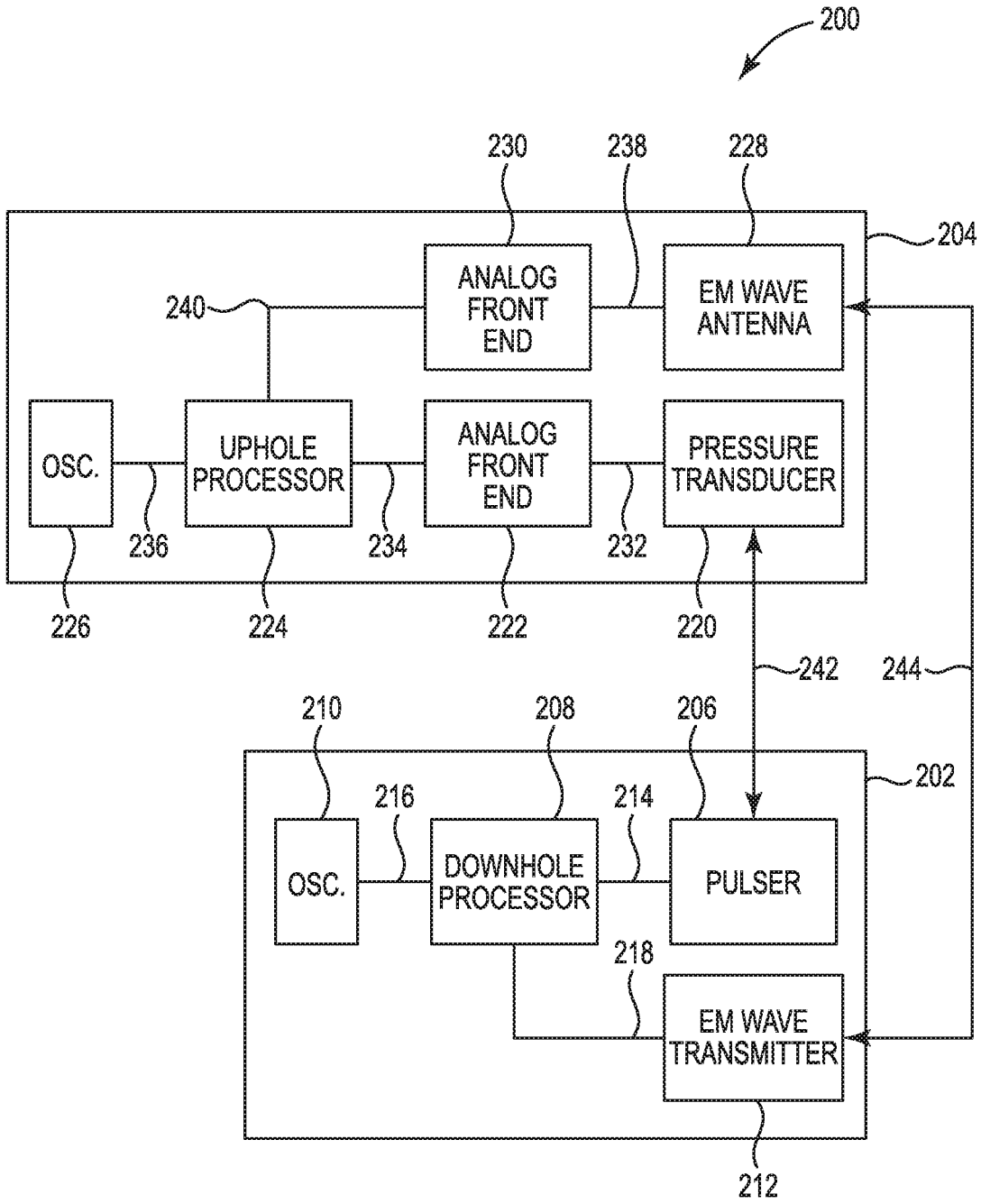
FIG. 3 is a diagram illustrating an MWD system configured to measure the length of a drill string using an electromagnetic (EM) wave communications channel and pulses through a fluidic medium in the drill string, according to embodiments of the disclosure.

FIG. 3 is a diagram illustrating an MWD system 200 configured to measure the length of a drill string, such as drill string 22, using an electromagnetic (EM) wave communications channel and pulses through a fluidic medium in the drill string, according to embodiments of the disclosure. The MWD system 200 includes a first module 202 and a second module 204 configured to communicate through EM waves and through the fluidic medium in the drill string. In some embodiments, the MWD system 200 is similar to the MWD system 20 of FIG. 1. In some embodiments, the first module 202 is similar to the first module 60 (shown in FIG. 1). In some embodiments, the second module 204 is similar to the second module 62 (shown in FIG. 1). In some embodiments, the MWD system 200 is configured to measure the length of the drill string, such as drill string 22, using the EM wave communications channel and one or more acoustic signals through a transmission medium.

The first module 202 is a downhole module situated at the distal end of the drill pipe, such as drill pipe 38, and situated at the distal end of the drill string 22. In some embodiments, the first module 202 is securely attached to the drill pipe. In some embodiments, the first module 202 is rotatably attached to the drill pipe.

The first module 202 includes a pulser 206, a downhole processor 208, an oscillator 210, and an EM wave transmitter 212. The pulser 206 is communicatively coupled at 214 to the downhole processor 208, and the oscillator 210 is communicatively coupled at 216 to the downhole processor 208. Also, the EM wave transmitter 212 is communicatively coupled at 218 to the downhole processor 208. In some embodiments, the pulser 206 is electrically coupled at 214 to the downhole processor 208. In some embodiments, the oscillator 210 is electrically coupled at 216 to the downhole processor 208. In some embodiments, the EM wave transmitter 212 is electrically coupled at 218 to the downhole processor 208.

The pulser 206 is situated at the distal end of the drill string and configured to provide a pressure pulse in the fluidic medium, such as the drilling mud, in the drill string. In some embodiments, the pulser 206 is a mud pulse valve.

The EM wave transmitter 212 is configured to transmit an EM wave to the surface. In some embodiments, the EM wave transmitter 212 transmits a wave in the radio frequency (RF) range. In some embodiments, the EM wave transmitter 212 transmits a wave in another suitable frequency range for reaching the surface.

The downhole processor 208 is configured to direct the pulser 206 to provide the pressure pulse in the fluidic medium and the EM wave transmitter 212 to transmit the EM wave at the same time. In embodiments, the downhole processor 208 is a computing machine that includes memory that stores executable code that can be executed by the computing machine to perform the processes and functions described in this disclosure. In embodiments, the computing machine is one or more of a computer, a microprocessor, and a micro-controller, or the computing machine includes multiples of a computer, a microprocessor, and a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, the first module 202 includes one or more power supplies for providing power to the components of the first module 202, such as the pulser 206, the downhole processor 208, the oscillator 210, and the EM wave transmitter 212.

The oscillator 210 provides a signal that is received by the downhole processor 208 and used by the downhole processor 208 to provide a timer or clock. In some embodiments, based on this timer, the downhole processor 208 directs the pulser 206 to provide the pressure pulse in the fluidic medium and the EM wave transmitter 212 to transmit the EM wave at the same time. In some embodiments, the oscillator 110 is a high precision oscillator. In some embodiments, the oscillator 210 provides a high frequency oscillating signal, such as an analog signal or a digital signal that is received by the downhole processor 208 for clocking the timer in the downhole processor 208. In some embodiments, the oscillator 210 provides a count, such as from a high precision counter, which is received by the downhole processor 208 for providing the timer in the downhole processor 208.

The second module 204 is an uphole module situated at the proximal end of the drill string, such as drill string 22. In some embodiments, the second module 204 is attached to the drill rig, such as drill rig 24. In some embodiments, the second module 204 is attached to the drill rig at the surface. In some embodiments, the second module 204 is securely attached to the drill rig. In some embodiments, the second module 204 is rotatably attached to the drill rig.

The second module 204 includes a pressure transducer 220, a first analog signal front end 222, an uphole processor 224, an oscillator 226, an EM wave antenna 228, and a second analog signal front end 230. The pressure transducer 220 is communicatively coupled at 232 to the first analog signal front end 222, which is communicatively coupled at 234 to the uphole processor 224, which is communicatively coupled at 236 to the oscillator 226. Also, the EM wave antenna 228 is communicatively coupled at 238 to the second analog signal front end 230, which is communicatively coupled at 240 to the uphole processor 224. In some embodiments, the pressure transducer 220 is electrically coupled at 232 to the first analog signal front end 222. In some embodiments, the first analog signal front end 222 is electrically coupled at 234 to the uphole processor 224. In some embodiments, the uphole processor 224 is electrically coupled at 236 to the oscillator 226. In some embodiments, the EM wave antenna 228 is electrically coupled at 238 to the second analog signal front end 230. In some embodiments, the second analog signal front end 230 is electrically coupled at 240 to the uphole processor 224.

The pressure transducer 220 operates as a sensor to sense the pressure pulse provided by the pulser 206 via pulse channel 242. The pressure transducer 220 provides signals, such as analog signals, to the first analog signal front end 222 that receives the signals from the pressure transducer 220 and filters the signals to provide filtered signals to the uphole processor 224. In some embodiments, the pulse channel 242 is a mud channel.

The EM wave antenna 228 is configured to receive the EM wave transmitted, via EM wave channel 244, by the EM wave transmitter 212. The EM wave antenna 228 provides signals, such as analog signals, to the second analog signal front end 230 that receives the signals from the EM wave transmitter 212 and filters the signals to provide filtered signals to the uphole processor 224.

The uphole processor 224 receives the filtered signals from the first analog signal front end 222 and the filtered signals from the second analog signal front end 230 to determine a distance from the first module 202 to the second module 204 and to determine a length of the drill string. The EM wave antenna 228 receives the EM wave at a first time and the pressure transducer 220 receives the pressure pulse at a second time. The uphole processor 224 is configured to determine a difference in time between the first time and the second time to determine the distance from the first module 202 to the second module 204 and to determine the length of the drill string. In some embodiments, the uphole processor 224 receives the signals directly from the pressure transducer 220. In some embodiments, the uphole processor 224 receives the signals directly from the EM wave antenna 228.

In some embodiments, the uphole processor 224 is a computing machine that includes memory that stores executable code that can be executed by the computing machine to perform the processes and functions described in this disclosure. In embodiments, the computing machine is one or more of a computer, a microprocessor, and a micro-controller, or the computing machine includes multiples of a computer, a microprocessor, and a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, the second module 204 includes one or more power supplies for providing power to the components of the second module 204, such as the pressure transducer 220, the first analog signal front end 222, the uphole processor 224, the oscillator 226, the EM wave antenna 228, and the second analog signal front end 230.

The oscillator 226 provides a signal that is received by the uphole processor 224 to be used for one or more of clocking the uphole processor 224 and providing a clock or timer in the uphole processor 224. In some embodiments, the oscillator 224 is a high precision oscillator. In some embodiments, the oscillator 224 provides a high frequency oscillating signal, such as an analog signal or a digital signal, which is received by the uphole processor 224. In some embodiments, the oscillator 224 provides a count, such as from a high precision counter, which is received by the uphole processor 224 for providing the timer in the uphole processor 120.

In operation, the downhole processor 208 directs the pulser 206 to provide a pressure pulse in the pulse channel 242 at a specific transmission time and the downhole processor 208 directs the EM wave transmitter 212 to transmit the EM wave in the EM wave channel 244 at the same specific transmission time. In some embodiments, the downhole processor 208 is configured to direct the pulser 206 to provide the pressure pulse and the EM wave transmitter 212 to provide the EM wave periodically, such as once every minute. In some embodiments, the downhole processor 208 is configured to direct at least one of the pulser 206 to provide multiple pressure pulses and the EM wave transmitter 212 to provide multiple EM wave transmissions at each transmission time, where the multiple pulses and multiple EM wave transmissions can be provided at one frequency or at a changing frequency.

The EM wave antenna 228 receives the EM wave and sends signals indicating arrival of the EM wave to the second analog signal front end 230, which sends filtered signals to the uphole processor 224. The uphole processor 224 determines and records that the EM wave arrived at a first time. The pressure transducer 220 senses the pressure pulse and sends signals indicating arrival of the pressure pulse to the first analog signal front end 222, which sends filtered signals to the uphole processor 224 at a second time. The uphole processor 224 determines and records that the pressure pulse arrived at a second time. In some embodiments, the uphole processor 224 receives signals directly from at least one of the EM wave antenna 228 and the pressure transducer 220.

The uphole processor 224 determines the difference in time between the first time and the second time. To determine the distance from the first module 202, such as from the pulser 206, to the second module 204, such as to the pressure transducer 220, the uphole processor 224 multiples the difference in time between the first time and the second time by the speed of the pressure pulse through the fluidic medium. The result is the distance from the first module 202 to the second module 204, where the length of the drill string can be determined from this distance. In some embodiments, the speed of the pressure pulse through the fluidic medium, such as drilling mud, is about 5000 feet per second, such that if the difference in time is 3 seconds, the distance from the first module 202 to the second module 204 is 15,000 feet. In some embodiments, the difference in time between the first time and the second time is adjusted for travel time of the EM wave from the EM wave transmitter 212 to the EM wave antenna 228 and this adjusted difference in time is multiplied times the speed of the pressure pulse through the fluidic medium to determine the distance from the first module 202 to the second module 204.

In other embodiments, in operation, the downhole processor 208 directs the pulser 206 to provide an acoustic signal at a specific transmission time and the downhole processor 208 directs the EM wave transmitter 212 to transmit the EM wave in the EM wave channel 244 at the same specific transmission time. In some embodiments, the downhole processor 208 is configured to direct the pulser 206 to provide the acoustic signal and the EM wave transmitter 212 to provide the EM wave periodically, such as once every minute. In some embodiments, the downhole processor 208 is configured to direct at least one of the pulser 206 to provide multiple acoustic signals and the EM wave transmitter 212 to provide multiple EM wave transmissions at each transmission time, where the multiple acoustic signals and multiple EM wave transmissions can be provided at one frequency or at changing frequencies.

The EM wave antenna 228 receives the EM wave and sends signals indicating arrival of the EM wave to the second analog signal front end 230, which sends filtered signals to the uphole processor 224. The uphole processor 224 determines and records that the EM wave arrived at a first time. A acoustic sensor at the surface senses the acoustic signal and sends signals indicating arrival of the acoustic signal to the first analog signal front end 222, which sends filtered signals to the uphole processor 224 at a second time. The uphole processor 224 determines and records that the acoustic signal arrived at a second time. In some embodiments, the uphole processor 224 receives signals directly from at least one of the EM wave antenna 228 and the acoustic signal sensor.

The uphole processor 224 determines the difference in time between the first time and the second time. To determine the distance from the first module 202, such as from the pulser 206, to the second module 204, such as to the acoustic signal sensor, the uphole processor 224 multiples the difference in time between the first time and the second time by the speed of the acoustic signal through the transmission medium. The result is the distance from the first module 202 to the second module 204, where the length of the drill string can be determined from this distance. In some embodiments, the difference in time between the first time and the second time is adjusted for travel time of the EM wave from the EM wave transmitter 212 to the EM wave antenna 228 and this adjusted difference in time is multiplied times the speed of the acoustic signal through the transmission medium to determine the distance from the first module 202 to the second module 204.

Figure 4:
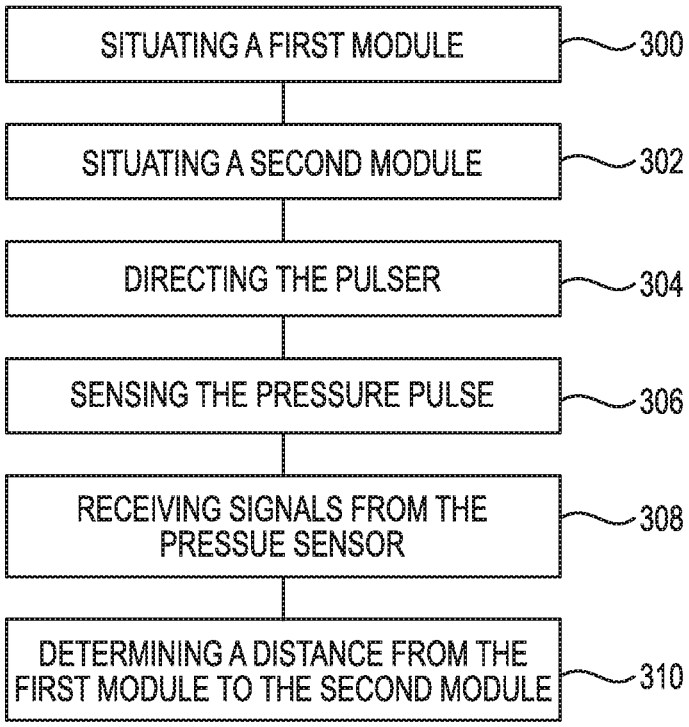
FIG. 4 is a diagram illustrating a method of determining a length of a drill string in an MWD system, according to embodiments of the disclosure.

FIG. 4 is a diagram illustrating a method of determining a length of a drill string in an MWD system, according to embodiments of the disclosure. The drill string includes a fluidic medium, such as drill mud. In some embodiments, the drill string is similar to drill string 22 (shown in FIG. 1). In some embodiments, the MWD system is similar to MWD system 20 of FIG. 1. Also, this example method is described as using pressure pulses through a fluidic medium, however, in other embodiments, this method includes using acoustic signals through a transmission medium.

The method, at 300, includes situating a first module at a distal end of the drill string. The first module includes a downhole processor and a pulser, such as a mud pulse valve, at the distal end of the drill string. The pulser is configured to provide a pressure pulse in the fluidic medium. In some embodiments, the first module is securely attached to the drill string. In some embodiments, the first module can be rotatably or otherwise attached to the drill string.

At 302, the method includes situating a second module at a proximal end of the drill string. The second module includes an uphole processor and a pressure sensor at the proximal end of the drill string. The pressure sensor is configured to sense the pressure pulse in the fluidic medium. In some embodiments, the second module is situated at the surface. In some embodiments, the first module is attached to the rig, such as rig 24.

At 304, the method includes directing the pulser to provide a pressure pulse through the fluidic medium. The downhole processor directs the pulser to provide the pressure pulse. At 306, the method includes sensing the pressure pulse at the pressure sensor. Where, the pressure sensor provides signals indicating that the pulse has arrived. In embodiments, these signals are either provided to an analog front end and then to the uphole processor or they can be delivered directly to the uphole processor in the second module.

At 308, the method includes receiving the signals from the pressure sensor at the uphole processor, either through the analog front end or directly from the pressure sensor. At 310, the method includes determining a distance, by the uphole processor, from the first module to the second module based on the signals from the pressure sensor to determine the length of the drill string.

In some embodiments, the method includes synchronizing in time the downhole processor and the uphole processor prior to directing the pulser, by the downhole processor, to provide the pressure pulse at a first time and sensing the pressure pulse at the pressure sensor at a second time. This method further includes determining a difference in time between the first time and the second time to determine the distance from the first module to the second module. Where, in some embodiments, the uphole processor is configured for multiplying the difference in time by the speed of the pressure pulse through the fluidic medium to determine the distance from the first module to the second module and, based on this distance, determining the length of the drill string. In some embodiments, the length of the drill string is equal to the determined distance. In some embodiments, synchronizing the downhole processor and the uphole processor includes synchronizing a first oscillator electrically coupled to the downhole processor and a second oscillator electrically coupled to the uphole processor.

In some embodiments, the method includes providing an EM wave transmitter in the first module and directing, by the downhole processor, the pulser to provide the pressure pulse and the EM wave transmitter to transmit an EM wave at the same transmission time. In some embodiments, this method includes providing an EM wave antenna on the second module to receive the EM wave, receiving the EM wave at the EM wave antenna at a first time, receiving the pressure pulse at the pressure sensor at a second time, and determining, by the uphole processor, a difference in time between the first time and the second time. In some embodiments, the uphole processor is configured for multiplying this difference in time by the speed of the pressure pulse through the fluidic medium to determine the distance from the first module to the second module. In some embodiments, the uphole processor is configured for adjusting the difference in time for travel time of the EM wave and multiplying the adjusted difference in time by the speed of the pressure pulse through the fluidic medium to determine the distance from the first module to the second module. Also, based on the determined distance, the uphole processor is configured for determining the length of the drill string. In some embodiments, the length of the drill string is the same as the determined distance.

Figure 5:
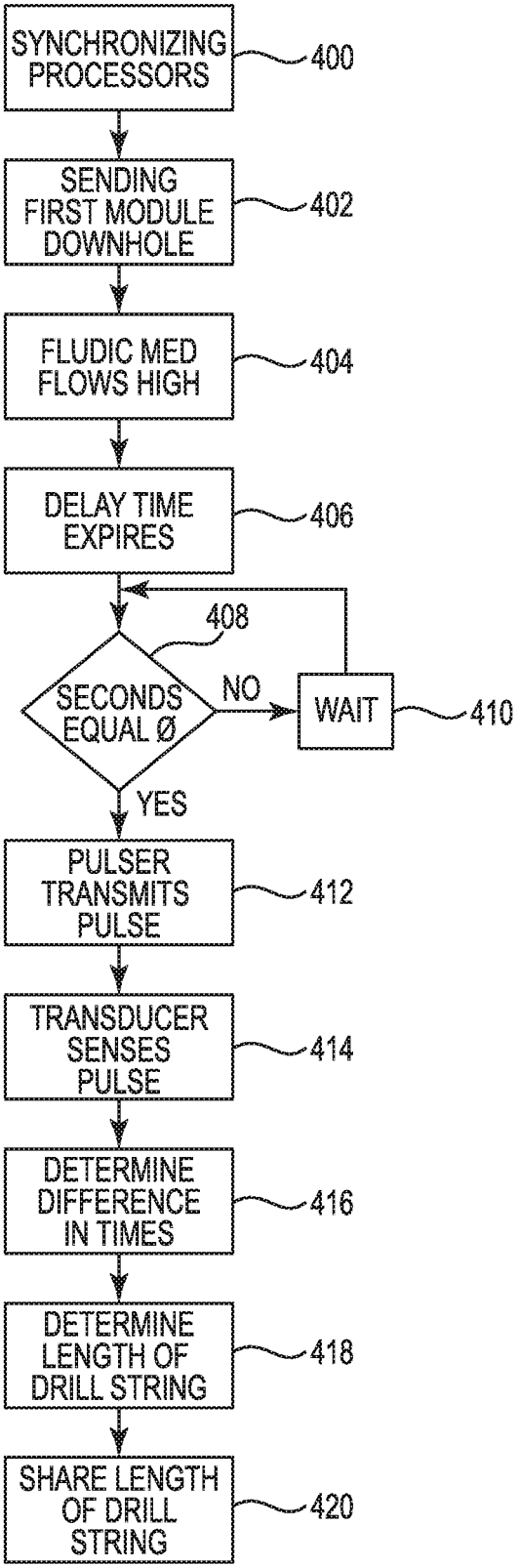
FIG. 5 is a diagram illustrating a method of determining the length of a drill string in an MWD system using synchronized timers or clocks and one or more pressure pulses transmitted through the fluidic medium in the drill string, according to embodiments of the disclosure.

FIG. 5 is a diagram illustrating a method of determining the length of a drill string in an MWD system using synchronized timers or clocks and one or more pressure pulses transmitted through the fluidic medium in the drill string, according to embodiments of the disclosure. The MWD system includes a first module and a second module configured to communicate through the fluidic medium in the drill string. The first module includes a pulser, a downhole processor, and an oscillator. The second module includes a pressure transducer, an uphole processor, an oscillator and, at least optionally, an analog signal front end. In some embodiments, the drill string is similar to drill string 22 (shown in FIG. 1). In some embodiments, the MWD system is similar to the MWD system 20 of FIG. 1. In some embodiments, the MWD system is similar to the MWD system 100 of FIG. 2. Also, this example method is described as using pressure pulses through a fluidic medium, however, in other embodiments, this method includes using acoustic signals through a transmission medium.

At 400, the method includes synchronizing in time the downhole processor and the uphole processor, at the surface. In some embodiments, synchronizing the downhole processor and the uphole processor includes synchronizing the oscillator coupled to the downhole processor and the oscillator coupled to the uphole processor. In some embodiments, synchronizing the downhole processor and the uphole processor includes synchronizing the timer in the downhole processor and the timer in the uphole processor. In other embodiments, synchronizing the downhole processor and the uphole processor can be done after sending the first module down a previously drilled well borehole. In other embodiments, synchronizing the downhole processor and the uphole processor can be done after sending the first module down to drill the well borehole.

At 402, the method includes sending the first module, including the synchronized downhole processor and the pulser, down a well borehole. At 404 the fluidic medium, such as the drilling mud, goes high in the drill string, such that the drill string contains the fluidic medium for communicating the pressure pulse from the first module in the well borehole to the second module at the surface.

Next, at 406, in some embodiments, a preprogramed transmit delay time in the synchronized downhole processor expires and, at 408 and 410, the downhole processor waits until the seconds portion of the timer or clock is at zero.

At 412, after the timer reaches zero, the downhole processor directs the pulser to provide a pressure pulse through the fluidic medium channel. This is the first time, where this first time is coordinated with and known by the synchronized uphole processor. In some embodiments, the downhole processor is configured to direct the pulser to provide the pressure pulse periodically, such as once every minute. In some embodiments, the downhole processor is configured to direct the pulser to provide multiple pressure pulses at each time. In some embodiments, multiple pulses can be provided at one frequency, such as one per second for a period of time, or at a changing frequency, such as one per second and then one every two seconds for a period of time.

At 414, the pressure transducer that serves as a pressure sensor, senses the pressure pulse at a second time and provides signals indicating the arrival of the pressure pulse to the uphole processor. In some embodiments, the pressure transducer provides the signals to the analog signal front end, which sends filtered signals to the uphole processor. In some embodiments, the pressure transducer provides the signals directly to the uphole processor.

At 416, the uphole processor receives the signals or the filtered signals that indicate the arrival of the pressure pulse at the pressure transducer. The uphole processor records the second time and determines the difference in time between the first time and the second time. This is the travel time for the pressure pulse in the fluidic medium between the first module and the second module.

At 418, the uphole processor determines the distance from the first module to the second module, which is at least approximately the length of the drill string. The uphole processor determines the distance by multiplying the difference in time between the first time and the second time by the speed of the pressure pulse through the fluidic medium, such as through the drilling mud. Which speed may vary due to the density of the drilling mud. The result is the distance from the first module to the second module. In some embodiments, the distance from the first module to the second module is used as the length of the drill string. In some embodiments, determining the length of the drill string from the determined distance includes a more precise calculation using factors, such as the length of the drill string that is not between the first module and the second module, placement of the pulser in the drill string, and placement of the pressure transducer in the drill string. As an example, in some embodiments, the speed of the pressure pulse through the fluidic medium, such as drilling mud, is about 5000 feet per second, such that if the difference in time is 3 seconds, the distance from the first module to the second module is 15,000 feet (which could be used as the length of the drill string or adjusted in a more precise calculation to determine the length of the drill string.

At 420, at least one of the distance from the first module to the second module and the length of the drill string is shared with the rest of the MWD system, including the rig.

Figure 6:
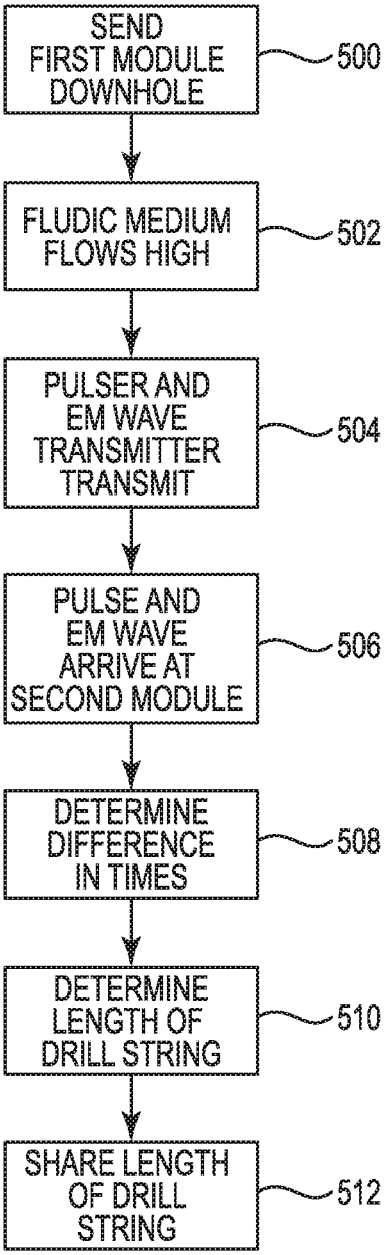
FIG. 6 is a diagram illustrating a method of determining the length of a drill string in an MWD system using EM waves in an EM wave communications channel and pressure pulses through a fluidic medium in the drill string, according to embodiments of the disclosure.

FIG. 6 is a diagram illustrating a method of determining the length of a drill string in an MWD system using EM waves in an EM wave communications channel and pressure pulses through a fluidic medium in the drill string, according to embodiments of the disclosure. The MWD system includes a first module and a second module configured to communicate through EM waves and the fluidic medium in the drill string. The first module includes a pulser, a downhole processor, an oscillator, and an EM wave transmitter. The second module includes a pressure transducer, a first optional analog signal front end, an uphole processor, an oscillator, an EM wave antenna, and a second optional analog signal front end. In some embodiments, the drill string is similar to drill string 22 (shown in FIG. 1). In some embodiments, the MWD system is similar to the MWD system 20 of FIG. 1. In some embodiments, the MWD system is similar to the MWD system 200 of FIG. 3. Also, this example method is described as using pressure pulses through a fluidic medium, however, in other embodiments, this method includes using acoustic signals through a transmission medium.

At 500, the method includes sending the first module, including the downhole processor, the pulser, and the EM wave transmitter down a well borehole. At 502 the fluidic medium, such as the drilling mud, goes high in the drill string, such that the drill string contains the fluidic medium for communicating the pressure pulse from the first module in the well borehole to the second module at the surface.

At 504, after the fluidic medium in the drill sting goes high, the downhole processor directs the pulser to provide a pressure pulse in the pulse channel at a specific transmission time and the downhole processor directs the EM wave transmitter to transmit the EM wave in the EM wave channel at the same transmission time. In some embodiments, the downhole processor directs the pulser to provide the pressure pulse and the EM wave transmitter to provide the EM wave periodically, such as once every minute. In some embodiments, the downhole processor directs at least one of the pulser to provide multiple pressure pulses and the EM wave transmitter to provide multiple EM wave transmissions at each transmission time. In some embodiments, at least one of the multiple pulses and the multiple EM wave transmissions can be provided at one frequency or at a changing frequency.

At 506, the EM wave antenna on the second module receives the EM wave and provides signals indicating the arrival of the EM wave. These signals are either provided directly to the uphole processor or the signals are provided to the second optional analog signal front end, which provides filtered signals to the uphole processor. The uphole processor determines and records that the EM wave arrived at a first time. Also, the pressure transducer senses the pressure pulse and provides signals to either the uphole processor directly or to the first optional analog signal front end, which provides filtered signals to the uphole processor. The uphole processor determines and records that the pressure pulse arrived at a second time.

At 508, the uphole processor receives the signals or filtered signals that indicate the arrival of the EM wave at the EM wave antenna and the arrival of the pressure pulse at the pressure transducer. The uphole processor determines the difference in time between the first time and the second time. In some embodiments, this difference is determined to be the travel time for the pressure pulse in the fluidic medium between the first module and the second module. In some embodiments, the difference in time between the first time and the second time is adjusted for travel time of the EM wave from the EM wave transmitter to the EM wave antenna, and this adjusted travel time is determined to be the travel time for the pressure pulse in the fluidic medium between the first module and the second module.

At 510, the uphole processor determines the distance from the first module to the second module, which is, at least approximately, the length of the drill string.

In some embodiments, the uphole processor determines the distance by multiplying the difference in time between the first time and the second time by the speed of the pressure pulse through the fluidic medium, such as through the drilling mud, where the speed of the pressure pulse through the fluidic medium can vary due to the density of the drilling mud. The result is the distance from the first module to the second module. In some embodiments, this distance from the first module to the second module is used as the length of the drill string. In some embodiments, determining the length of the drill string from the determined distance includes a more precise calculation using factors, such as the length of the drill string that is not between the first module and the second module, placement of the pulser in the drill string, and placement of the pressure transducer in the drill string.

In some embodiments, the uphole processor determines the distance by multiplying the adjusted difference in time between the first time and the second time by the speed of the pressure pulse through the fluidic medium, such as through the drilling mud, where the speed of the pressure pulse through the fluidic medium can vary due to the density of the drilling mud. This result is the distance from the first module to the second module. In some embodiments, this distance from the first module to the second module is used as the length of the drill string. In some embodiments, determining the length of the drill string from the determined distance includes a more precise calculation using factors, such as the length of the drill string that is not between the first module and the second module, placement of the pulser in the drill string, and placement of the pressure transducer in the drill string.

As an example, in some embodiments, the speed of the pressure pulse through the fluidic medium, such as drilling mud, is about 5000 feet per second, such that if the difference in time or the adjusted difference in time is 3 seconds, the distance from the first module to the second module is 15,000 feet, which can be used as the length of the drill string or adjusted in a more precise calculation to determine the length of the drill string.

At 512, at least one of the distance from the first module to the second module and the length of the drill string is shared with the rest of the MWD system, including the rig.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

We claim:

1. A measurement while drilling system for a drill string having a fluidic medium in the drill string, the measurement while drilling system comprising:

a first module situated at a distal end of the drill string and including:

a downhole processor; and a pulser communicatively coupled to the downhole processor and configured to provide a pressure pulse in the fluidic medium; and an electromagnetic wave transmitter configured to transmit an electromagnetic wave;

a second module situated at a proximal end of the drill string and including:

an uphole processor;

a pressure sensor communicatively coupled to the uphole processor, and configured to sense the pressure pulse; and an electromagnetic wave antenna communicatively coupled to the uphole processor;

wherein the downhole processor is configured to direct the pulser to provide the pressure pulse and the electromagnetic wave transmitter to transmit the electromagnetic wave at the same time, the uphole processor configured to receive signals from the pressure sensor and the electromagnetic wave antenna to determine a distance from the first module to the second module.

2. The measurement while drilling system of claim 1, wherein the first module comprises a first oscillator electrically coupled to the downhole processor and the second module comprises a second oscillator electrically coupled to the uphole processor, and the first oscillator is synchronized to the second oscillator to synchronize the downhole processor and the uphole processor.

3. The measurement while drilling system of claim 2, wherein the difference in time is multiplied times the speed of the pressure pulse through the fluidic medium to determine the distance from the first module to the second module.

4. The measurement while drilling system of claim 1, wherein the electromagnetic wave antenna receives the electromagnetic wave at a first time and the pressure sensor receives the pressure pulse at a second time, and the uphole processor is configured to determine a difference in time between the first time and the second time to determine the distance from the first module to the second module.

5. The measurement while drilling system of claim 4, wherein at least one of: the difference in time is multiplied times the speed of the pressure pulse through the fluidic medium to determine the distance from the first module to the second module, and the difference in time is adjusted for travel time of the electromagnetic wave and the adjusted difference in time is multiplied times the speed of the pressure pulse through the fluidic medium to determine the distance from the first module to the second module.

6. The measurement while drilling system of claim 1, wherein the fluidic medium includes mud used in drilling and the pressure pulse travels through a mud channel in the drill string.

7. The measurement while drilling system of claim 1, wherein the downhole processor is configured to periodically direct the pulser to provide the pressure pulse.

8. The measurement while drilling system of claim 1, wherein the difference in time between the received electromagnetic wave signal and the pressure pulse signal is multiplied times the speed of the pressure pulse through the fluidic medium to determine the distance from the first module to the second module.

9. A measurement while drilling system for a drill string with a fluidic medium in the drill string, the measurement while drilling system comprising:

a first module situated at a distal end of the drill string and including a pulser configured to provide a pressure pulse in the fluidic medium, the first module including a downhole processor and an electromagnetic wave transmitter, the downhole processor communicatively coupled to the pulser and the electromagnetic wave transmitter; and a second module situated at a proximal end of the drill string and including a pressure sensor, an electromagnetic wave antenna, and an uphole processor communicatively coupled to the pressure sensor and the electromagnetic wave antenna, wherein the downhole processor is configured to direct the pulser to provide the pressure pulse and the electromagnetic wave transmitter to transmit the electromagnetic wave at the same time, such that the electromagnetic wave antenna receives the electromagnetic wave at a first time and the pressure sensor receives the pressure pulse at a second time, and wherein the uphole processor configured to determine a difference in time between the first time and the second time to determine the distance from the first module to the second module and to determine the length of the drill string.

10. A method of determining a length of a drill string in a measurement while drilling system, the drill string having a fluidic medium in the drill string, the method comprising:

situating a first module that includes an electromagnetic wave transmitter, a downhole processor and a pulser at a distal end of the drill string;

situating a second module that includes an uphole processor, a pressure sensor, and an electromagnetic wave antenna at a proximal end of the drill string;

directing the pulser and the electromagnetic wave transmitter, by the downhole processor, to provide a pressure pulse through the fluidic medium and to transmit an electromagnetic wave at the same time;

sensing the pressure pulse at the pressure sensor;

receiving signals from the pressure sensor and the electromagnetic wave antenna at the uphole processor; and determining a distance from the first module to the second module based on the signals from the pressure sensor and the electromagnetic wave antenna to determine the length of the drill string.

11. The method of claim 10, comprising:

synchronizing the downhole processor and the uphole processor;

directing the pulser, by the downhole processor, to provide the pressure pulse at a first time;

sensing the pressure pulse at the pressure sensor at a second time; and determining a difference in time between the first time and the second time to determine the distance from the first module to the second module.

12. The method of claim 11, wherein synchronizing the downhole processor and the uphole processor includes synchronizing a first oscillator electrically coupled to the downhole processor and a second oscillator electrically coupled to the uphole processor.

13. The method of claim 11, comprising:

multiplying the difference in time by the speed of the pressure pulse through the fluidic medium to determine the distance from the first module to the second module.

14. The method of claim 10, comprising:

providing an electromagnetic wave antenna on the second module to receive the electromagnetic wave;

receiving the electromagnetic wave at the electromagnetic wave antenna at a first time;

receiving the pressure pulse at the pressure sensor at a second time; and determining, by the uphole processor, a difference in time between the first time and the second time to determine the distance from the first module to the second module.

15. The method of claim 14, comprising at least one of:

multiplying the difference in time by the speed of the pressure pulse through the fluidic medium to determine the distance from the first module to the second module; and adjusting the difference in time for travel time of the electromagnetic wave and multiplying the adjusted difference in time by the speed of the pressure pulse through the fluidic medium to determine the distance from the first module to the second module.

16. The method of claim 10, comprising multiplying the difference in time between the pressure pulse signal and the electromagnetic wave signal by the speed of the pressure pulse through the fluidic medium to determine the distance from the first module to the second module.

* * * * *